US007398792B2

(12) United States Patent
Wu

(10) Patent No.: US 7,398,792 B2
(45) Date of Patent: Jul. 15, 2008

(54) BAR TABLE SHELTER

(76) Inventor: Weidan Wu, Yada Technology Group, Fengkeng Industrial Zone, Sanmen County, Zhejiang Provice 317100 (CN)

( * ) Notice: Subject to any disclaimer, the term of this patent is extended or adjusted under 35 U.S.C. 154(b) by 81 days.

(21) Appl. No.: 11/379,437

(22) Filed: Apr. 20, 2006

(65) Prior Publication Data

US 2006/0243313 A1 Nov. 2, 2006

(30) Foreign Application Priority Data

Apr. 28, 2005 (CN) ..... 2005 2 0101870 U

(51) Int. Cl.

| | |
|---|---|
| ***E04H 15/36*** | (2006.01) |
| ***E04H 15/44*** | (2006.01) |
| ***E04H 15/34*** | (2006.01) |
| ***E04H 15/02*** | (2006.01) |
| ***E04H 1/00*** | (2006.01) |
| ***A47B 37/00*** | (2006.01) |

(52) U.S. Cl. ..... 135/128; 135/96; 135/121; 52/36.2; 108/50.11

(58) Field of Classification Search ..... 135/96, 135/117, 144, 158, 157, 155, 16, 121, 159, 135/900, 902; 52/36.1, 85, 79.1, 222, 239, 52/36.2, 82; 108/50.11, 59, 64, 96; D25/56
See application file for complete search history.

(56) References Cited

U.S. PATENT DOCUMENTS

| | | | | |
|---|---|---|---|---|
| 1,936,428 | A * | 11/1933 | Friesner | 108/28 |
| 2,836,860 | A * | 6/1958 | Staropoli | 52/32 |
| 4,280,521 | A * | 7/1981 | Zeigler | 135/120.3 |
| 4,742,602 | A * | 5/1988 | Horner | 24/115 K |
| 6,659,546 | B2 * | 12/2003 | Schmeing et al. | 297/157.1 |
| 6,745,521 | B1 * | 6/2004 | Klemming | 52/79.6 |
| D500,144 | S * | 12/2004 | Tseng | D25/56 |
| 2002/0162490 | A1 * | 11/2002 | Petryna | 108/151 |
| 2004/0226487 | A1 * | 11/2004 | Yang | 108/50.12 |
| 2005/0235580 | A1 * | 10/2005 | Golden | 52/79.1 |
| 2006/0081283 | A1 * | 4/2006 | Ma | 135/121 |

* cited by examiner

*Primary Examiner*—David R Dunn
*Assistant Examiner*—Kaitlin A Wilson
(74) *Attorney, Agent, or Firm*—Global IP Services; Tianhua Gu

(57) ABSTRACT

A bar table shelter includes a roof member comprising top central connection assembly which further includes a multi-direction connector with multiple radius claw sleeves for receiving corresponding equal-numbered long bones inserted therein in one-touch manner, at the central top place of which there is a vertically erecting fastener pole for fastening a tarpaulin cloth; a standing frame member comprising at least three upright panels, which provides a bar table support frame and a shelter surrounding frame to support the roof member, each upright panel includes two upright pole members with different heights and at least a pair of lateral bars between the two upright pole members; a top connection assembly having top positioned lateral beams at middle place of which there is a U-shaped fork supporting the roof member, the lateral beam preferably is a arc shaped one, which positioned between the roof member and the standing frame. Thereby the present invention of bar table shelter not only has the function of a shelter but also of a bar table, it provide more convenience for outdoor use.

11 Claims, 6 Drawing Sheets

BAR TABLE SHELTER

CROSS REFERENCE TO THE RELATED PATENT APPLICATION

This application claims the priority benefit of the Chinese patent application No. 200520101870.4, filed on Apr. 28, 2005.

FIELD OF THE INVENTION

The present invention relates to a tarpaulin shelter or awning, which may be pitched up temporarily for outdoor use, more particularly, it relates to a tarpaulin shelter connected by prefabricated parts.

BACKGROUND OF THE INVENTION

In order to meet people's need in daily livelihood a variety of tarpaulin shelters are on sales in market, and such shelters include a top connection, long bones, lateral beams and upright panels, in which, the top connection and long bones are connected in plug-in manner to form a top tarpaulin framework for supporting the tarpaulin, and the upright panels are disposed under and around the top tarpaulin framework. The surrounding framework which supports top tarpaulin framework is formed by the upright panels, the lateral beams thereon and their connection. Such tarpaulin shelter has only the function of sheltering from sunlight and rain, although it brings convenience to outdoor use, however, it does not provide multi-function for the users, therefore, people need add in additional function such as combine a bar table and chairs under the tarpaulin shelter for resting and putting things such as bottles, dishes and the like thereon. Obviously, the current tarpaulin shelters in market are lack of a variety of usage and can not provide multi-functions to users

SUMMARY OF THE INVENTION

In order to overcome the defects of the tarpaulin shelters currently in use, the object of the present invention is to provide a variety of the usage for the users. The technical solution of the present invention is to provide a tarpaulin shelter having a bar table combined therewith in its new configuration, which possesses a variety of functions and provides more convenience to the user.

The present invention is a bar table shelter which includes following assemblies:

A roof member comprising top central connection assembly which further includes a multi-direction connector with multiple radius claw sleeves for receiving corresponding equal-numbered long bones inserted therein in one-touch manner, at the central top place of which there is a vertically erecting fastener pole for fastening a tarpaulin cloth.

A standing frame comprising at least three upright panels, which provides a bar table support frame and a shelter surrounding frame to support the roof member, each upright panel includes two upright pole members with different heights and at least a pair of lateral (transverse) bars between the two upright pole members.

A top connection assembly having top positioned lateral beams, at middle place of which there is a U-shaped fork supporting the roof member, the lateral beam preferably is a arc shaped one, which is positioned between the roof member and the standing frame.

The number of upright panel reflects the number of bar place which can provide a seat(s) for the user, that is to say, if a bar table shelter has three upright panels, that means a bar table shelter can provides three portions to the users for use. The shape of the bar table shelter can be altered by changing the number of the panels. The two upright pole members of each upright panel are respectively a first upright pole (long pole) disposed at distal end (surrounding periphery of the bar table shelter or standing frame) and a second upright pole disposed at center, which is shorter than the first upright pole.

As to each upright panel, between first and second upright poles there are pair of lateral beams, which surround a decorative member with special art pattern. To have a decorative member can increase the central part weight of lower portion of the shelter for increasing its standing stableness.

The second upright pole of each upright panel is put together to adjoin a middle upright pole to form an integrated body by means of a connecting member such as tenons and long holes, which becomes a support frame for supporting a table face on the plane formed by plurality of upper lateral beams of each upright panel.

The first and second upright poles preferably are hollow metal tube with a rectangular section. The middle upright pole uses a piece of hollow tube, it may have triangular or rectangular section according to the number of the upright panels adjoined therewith. The middle upright pole with triangular section is for three-upright panel connection, and the middle upright pole with rectangular section is for four-upright panel connection.

The core of connecting member is a middle upright pole, the middle upright pole is connected with the second upright pole of each upright panel by means of tenons and long holes in a "one-touch" manner in order to be mounted and dismounted rapidly. Of course, second upright poles may also be made into a whole integrated body by using other methods.

As a further improvement of the present invention, the circle table face plate can be formed by putting together a plurality of concentric arc shaped separate portion, and at the center of the circle there is a table-fastener member which is screwed on the upper end of the middle upright pole member for keeping a plurality of separate concentric arc shaped portion to be a complete circle table face.

The package of the shelter of present invention is compact and small after it being dismounted and wrapped-up, therefore it is convenient in transportation and storage.

As to roof connection, the two ends of each lateral arc beam which is disposed over the top of the first upright pole of plurality of upright panels can be respectively connected with the first upright pole of each upright panel in a one-touch plug-in manner, and an U-shaped roof supporting fork is fixed on the middle portion of the lateral arc beams for fastening the corresponding radius bone of the roof.

The roof of the bar table shelter of the present invention is configured by inserting one ends of plurality of radius bones into plurality of the receiving end of central multi-directional connector. There is a roof tarpaulin fastening short-pole with connection screw, which erects on the central top multi-directional connector for receiving a fastening cover with connection screw to fasten the tarpaulin.

In comparison with the prior art, the advantages of the present utility model lie in that: because of the lengths of the two upright pole members forming each upright panel are different from each other, the short second upright pole member of each upright panel can be used as a support for supporting the face plate of bar table so that the present invention has not only the function of sheltering from sunlight and rain, but also has the additional function for providing bar table, therefore it brings more convenience and versatile outdoor usage.

DETAILED DESCRIPTION OF THE INVENTION

Figure 1:
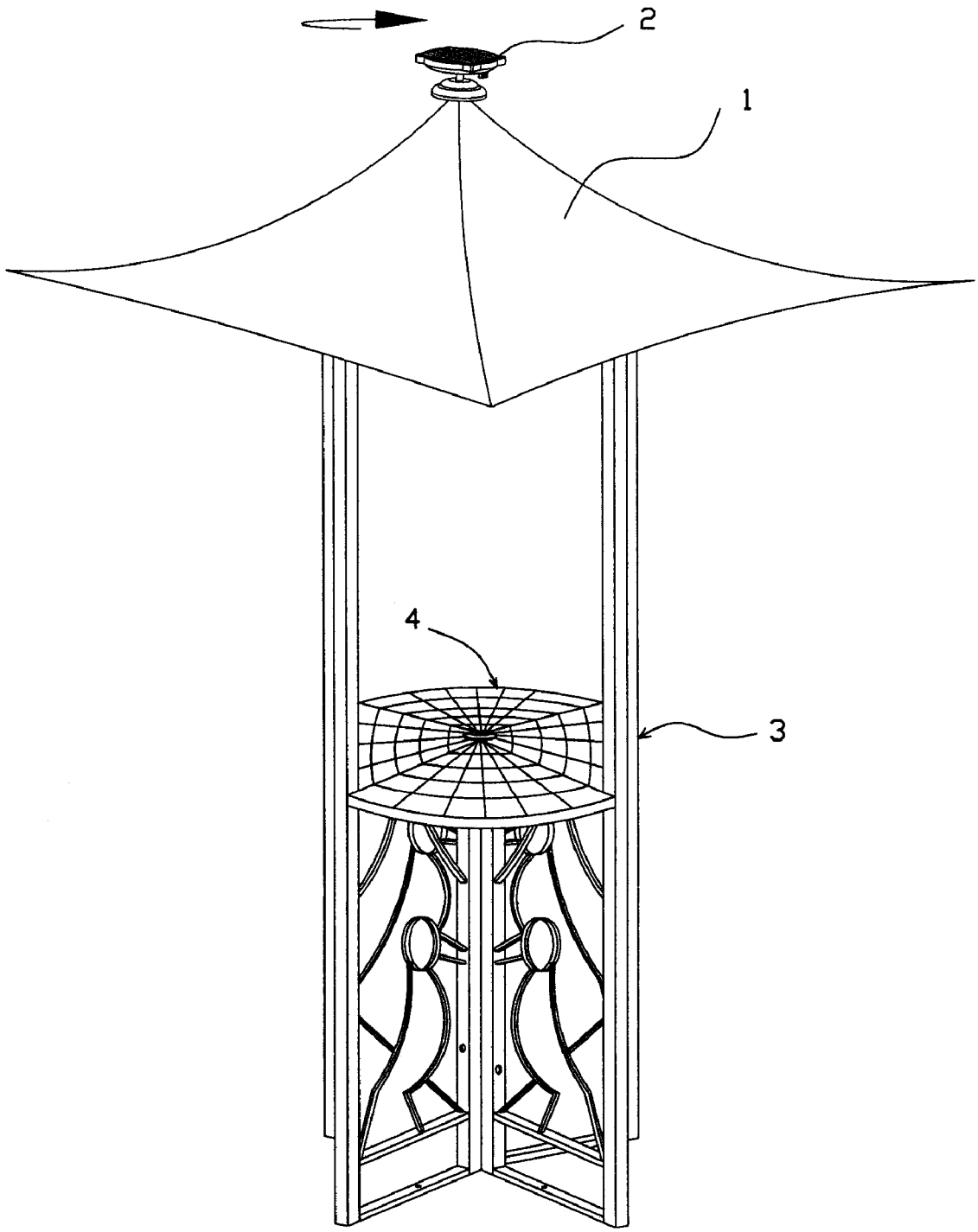
FIG. 1 is a perspective view of the preferred embodiment according to the present invention.

In the following the present invention will be further described with reference to the accompanying drawings.

As shown in from FIG. 1 to FIG. 6, the embodiment of the present invention is a tarpaulin shelter with bar table that is a square tarpaulin shelter with a four-portion bar for the use.

It includes a roof includes a tarpaulin 1, a four-directional top connector 9 and four long bones 8, top central connection assembly which further includes a four-direction connector with four radius claw sleeves for receiving corresponding equal-numbered long bones 8 inserted therein in one-touch manner. Over the top four-directional connector 9, there is a short pole 91 disposed over the top surface of the connector 9, which penetrates the tarpaulin and receives a screwed circular cover 2 from the other side of the tarpaulin for fastening the tarpaulin (refer to FIG. 1 and FIG. 5). Four arcuate lateral beams 6 are detachably mounted at the top end of the first upright pole 31 by one-touch plug-in manner i.e. inserting the tennons 62 at two ends of the beams 6 into the female ports 36 of top end of two first upright poles 31 (see FIG. 3).

Figure 2:
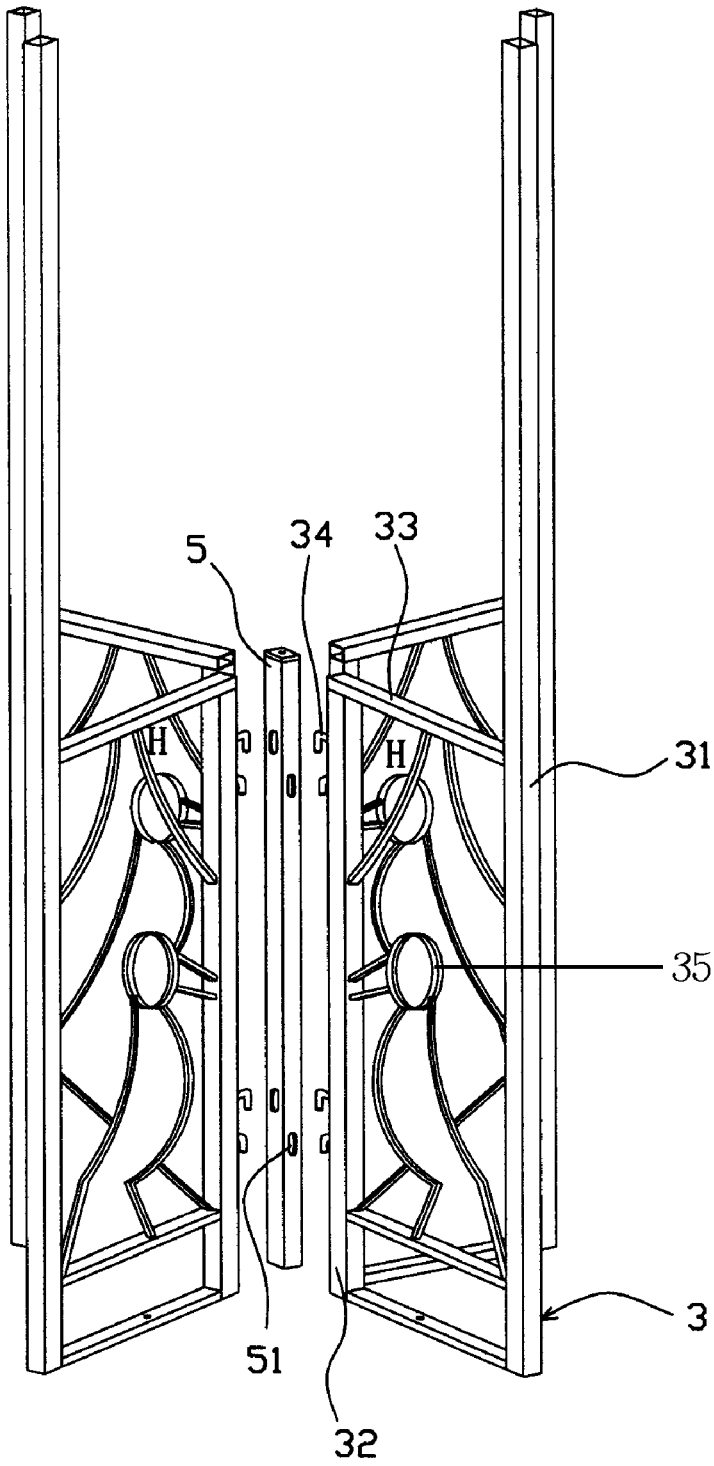
FIG. 2 is an exploded perspective view illustrating the relationship of the upright panels and the middle upright pole member in FIG. 1 to form a bar table.

Four upright panels 3 with decorative patterns 35 are connected with a centrally positioned middle upright pole 5 by joining of the tennons 34 disposed on the inner erect faces of the second upright pole 32 and long holes 51 disposed on the erect surfaces of the middle upright pole 5 (see FIG. 2).

Each upright panel 3 includes two upright pole members 31,32 and a pair of lateral bars 33 between the upright poles 31,32. Each upright panel 3 has a decorative art panel 35, which is surrounded by pole 31, 32 and of lateral bars 33.

FIG. 2 illustrates the connectional relationship between upright panel 3 and middle upright pole 5, in which the two upright erect members configuring the upright panel 3 are respectively a first upright pole 31 and a second upright pole 32 with different length. The first upright pole 31 is a longer upright erect member which is connected in a plug-in manner with the lateral beams 6, the second upright pole member 32 is shorter than the first upright erect member 31, and the second upright erect member 32 of each upright panel is connected with an adjacent middle upright pole 5, both are of same height.

Figure 3:
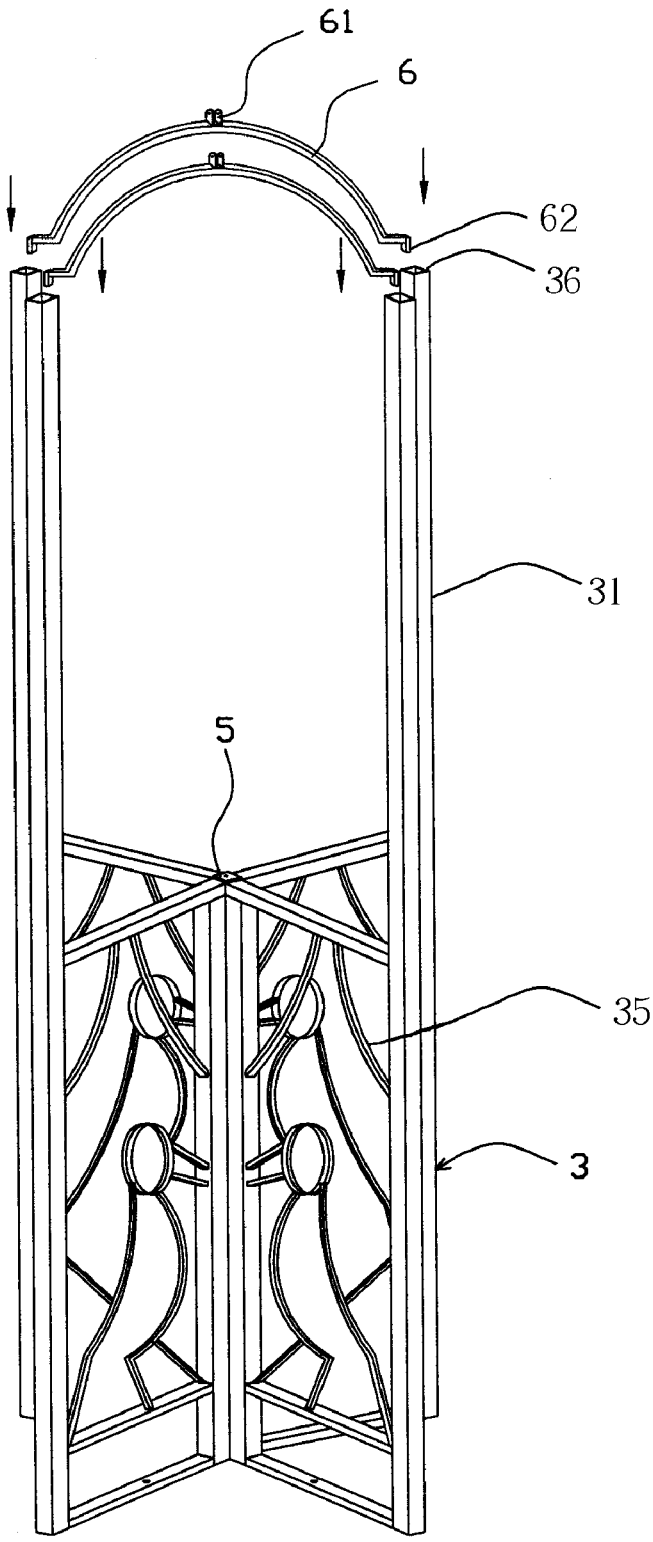
FIG. 3 is a perspective view showing that upright panels in FIG. 2 are put together with the middle upright pole member in a plug-in manner.

In the present embodiment, each second upright erect member 32 is connected to a middle upright pole 5 in a plug-in manner by means of tenons 34 and long holes 51, i.e. a tenon 34 is provided on the each second upright pole 32, and a long hole 51 is provided on the erect face of the middle upright pole corresponding to the tenon 34. When assembly is made, the tenon 34 is inserted into the long hole 51 of the middle upright pole, and then the upright panel is shifted downwards relative to the middle upright pole along with the longitudinal direction of the long hole 51 (see FIG. 2). By the same way, four upright panels can be integrated into one whole configuration to obtain the framework as shown in FIG. 3.

Figure 4:
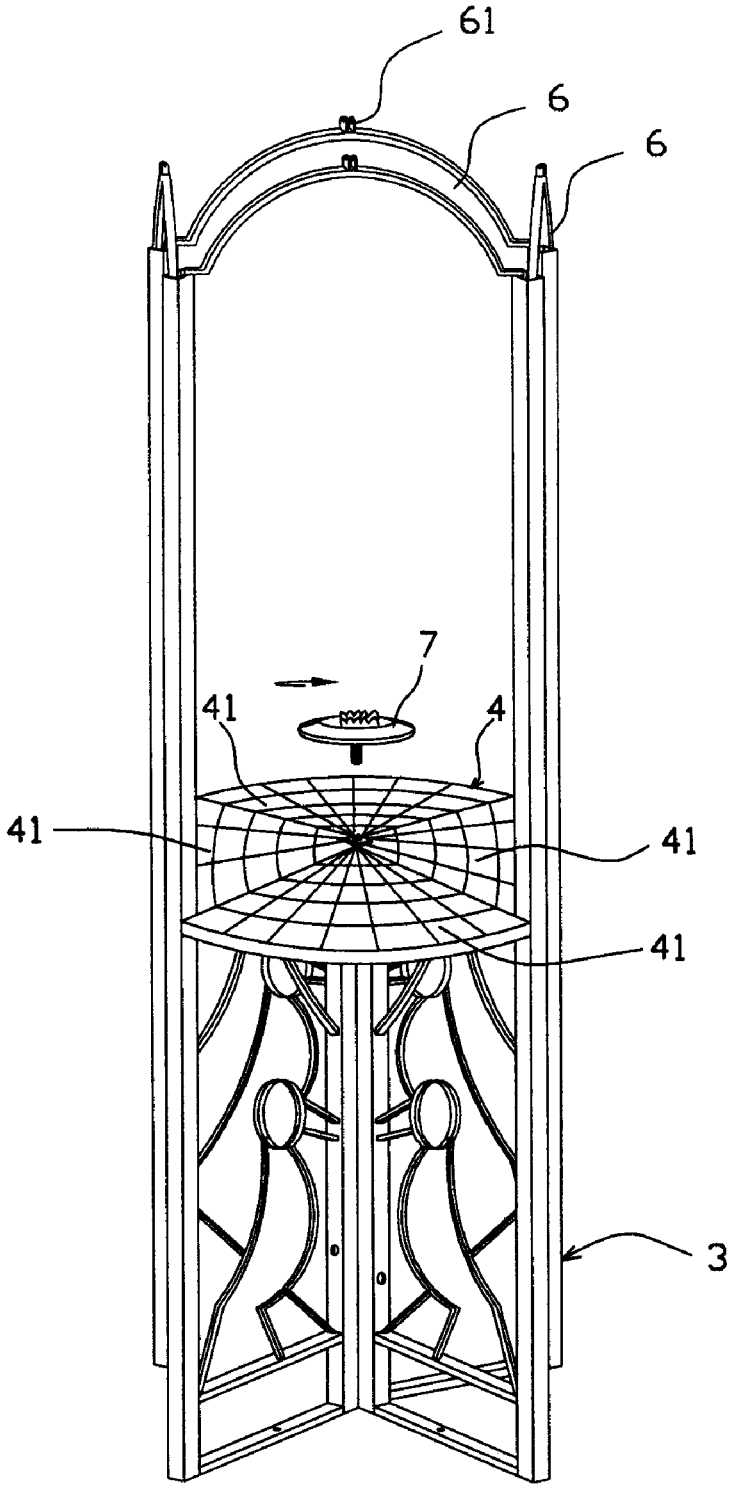
FIG. 4 is a perspective view showing that the lateral beams in FIG. 3 are assembled and that the table faceplate is put in place.

Then, a table face plate 4 is placed on the supporting frame formed by the second upright pole 32, middle upright pole 5 and upper lateral bar 33, as shown in FIG. 4. The table face plate 4 is formed by putting together four concentric arc-shaped panels 41 and the assembled center of the arc shaped panel 41 is fastened together as an integrated whole by a hand wheel 7, which is connected with the middle upright pole 5 by a screw connection (see FIG. 4).

The roof member has a four-directional top connector 9 and four long bones 8. Over the top four-directional connector 9, there is a short connection pole 91 disposed on the top surface of the connector 9, which penetrates the tarpaulin and receives a screw top cover 2 from the other side of the tarpaulin for fastening the tarpaulin therebetween (refer to FIG. 3, FIG. 4 and FIG. 5). Four arcuate lateral beams 6 are detachably mounted on the top end of the first upright pole 31 by one-touch plug-in manner i.e. inserting the tennons 62 at two ends of the beams 6 into the female ports 36 at the top ends of two adjacent first upright poles 31 (see FIG. 3).

A U-shaped supporting bracket 61 for receiving corresponding long bone 8 is fixed by welding on middle top portion of each lateral beams 6 with the fork upwards.

Figure 5:
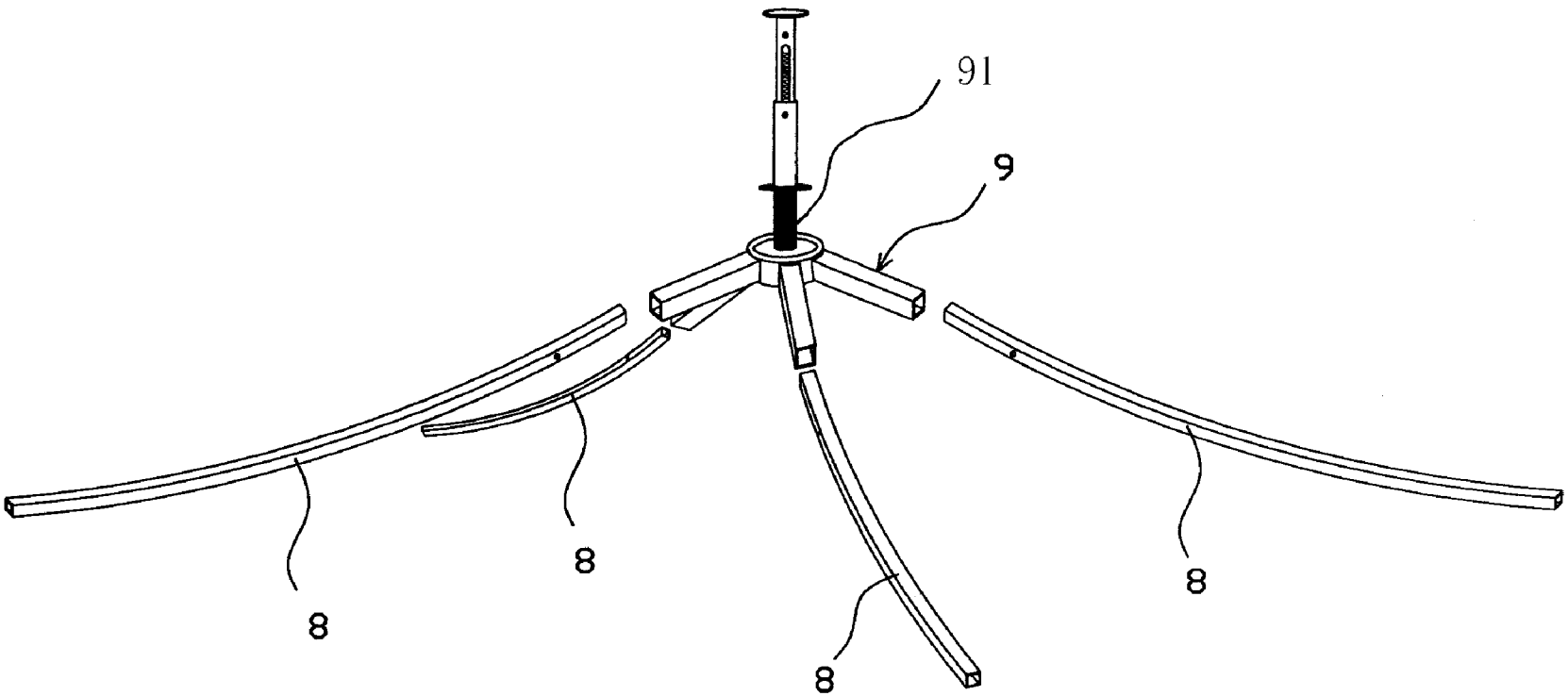
FIG. 5 is a perspective view of long bones and the top connection.

When assembling, the upper end of each long bone 8 is inserted into the claw sleeve tube (multi-directional connector) of the top connection 9 and is locked automatically by spring or elastic hook (not shown). Here, for the top connection, the conventional telescopic type top connection or shelter top is used as shown in FIG. 5 to adjust the height of the top of the shelter.

Figure 6:
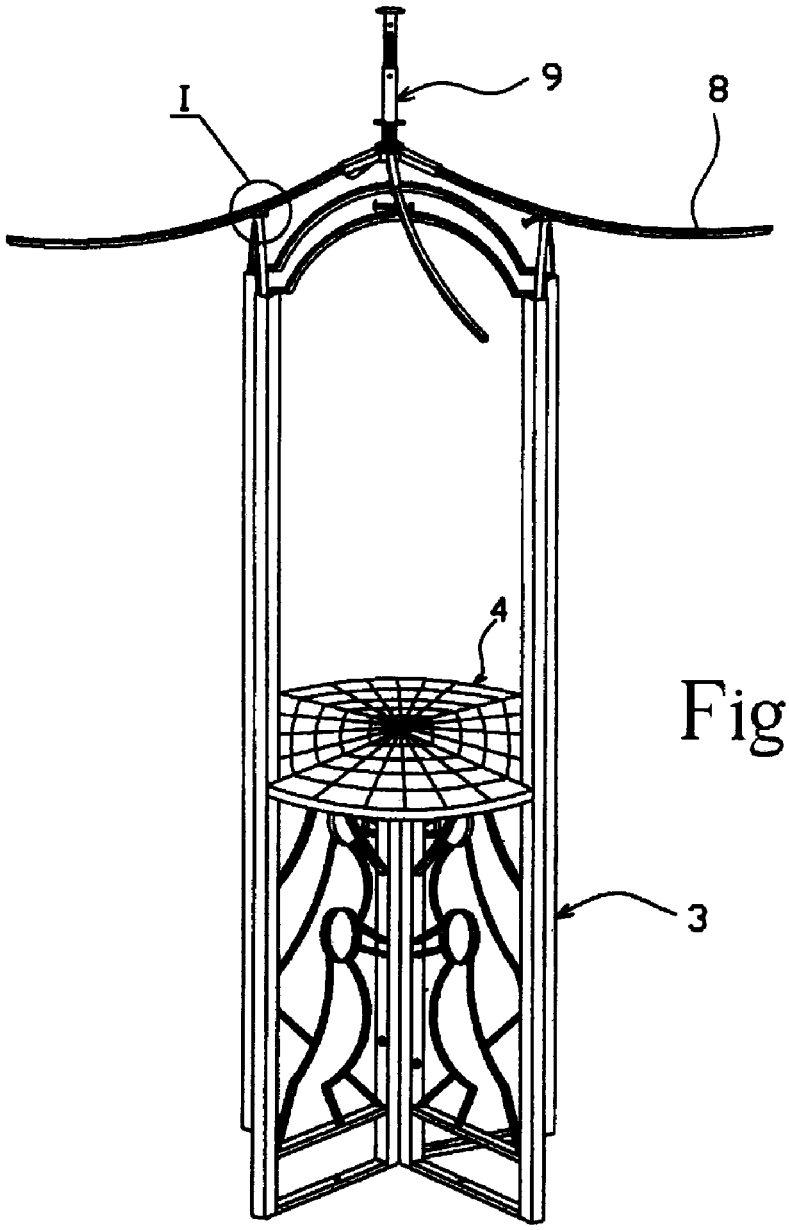
FIG. 6 is a perspective view showing that the long bones and top connection in FIG. 4 are assembled.
Figure 7:
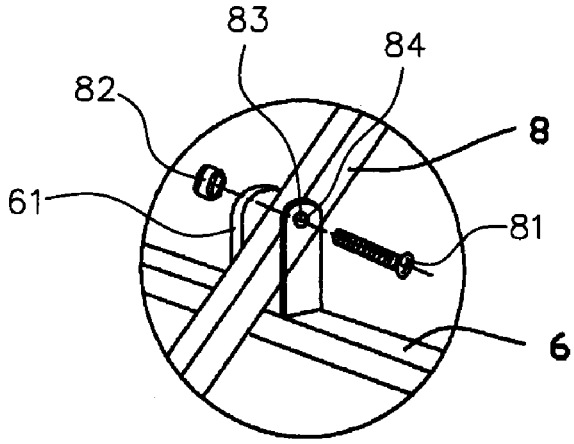
FIG. 7 is an enlarged perspective view of portion I of FIG. 6.

Then the middle portion of long bone 8 is clamped in the U-shaped support frame (fork) 61 of the lateral beams 6. In order to make the connection between them more firmly, the mounting holes 83 are provided on the side walls of the U shaped support frame (fork) 61 and through hole 84 is arranged in the corresponding position of the long bone 8, as shown in FIG. 6 and FIG. 7, a screw 81 are used to pass through the mounting hole 83 and the through hole 84 to fasten them in place by the lock nut 82. Finally the tarpaulin 1 is placed over the telescopic top connection 9, and the edge corners of the tarpaulin are placed over the protruding eventual ends of the long bone 8, the tarpaulin 1 is pressed tightly by using a cap cover 2 which is screwed into the screw hole of the top portion of the top connection to form the shelter or the awning in combination with the bar table, as shown in FIG. 1.

The protection of the present invention is not confined to the range of the embodiment, when the triangular, quinquangular or hexangular tarpaulin shelter are used, the number of lateral beam and upright panels will be increased correspondingly, the number of upright panels can also be four or five, the connecting members of other type may also be used, for example, the upper and lower ends of each second upright pole member can be connected and integrated into one body by means of upper and lower covers, and between the upright panels, partition boards may be mounted to increase the partitioning layers for placing more articles and to be used as goods vending frames etc., thereby such alterations also fall within the range of protection of the present invention.

What is claimed is:

1. A bar table shelter comprising:

a roof member having a multi-directional top connector, radius long bones connected with said multi-directional top connector, a piece of tarpaulin cloth covered and fastened on said radius long bones;

a standing frame member having at least three upright panels, each said upright panel including a first upright pole, a second upright pole which is shorter than said first upright pole, and at least a pair of lateral bars disposed between them, all said second shorter upright poles are fixed together as a central shorter upright pole to make said upright panels as a said standing frame member, said first higher upright poles form a shelter surrounding frame to support the roof member, the upper lateral bars of said upright panels form a table supporting frame for supporting a table face plate;

a connection member for connecting said roof member and said standing frame member and supporting said roof member having a plurality of lateral beams connected with top ends of said first upright poles, and supporting brackets for connecting said roof member located on said lateral beams.

2. The bar table shelter according to claim 1, wherein there is a fixing member for fixing said second upright poles together, said fixing member is a central positioned middle upright pole with connecting long holes, said second upright poles have tenons, inserting said tenons into said long holes to fix and combine said second upright poles together.

3. The bar table shelter according to claim 2, wherein a table face plate is formed by putting a number of concentric arc panels together, said arc panels are fastened by means of a screw handle wheel on said table supporting frame.

4. The bar table shelter according to claim 1, wherein tenons at two ends of said lateral beams are respectively inserted into female ports at the top ends of said first upright poles of said adjacent upright panel in a plug-in manner, and said supporting brackets are a U-shaped supporting fork arranged on the middle portion of said lateral beams for receiving and fixing said corresponding long bone therein.

5. The bar table shelter according to claim 1, wherein plurality of said long bones are radium inserted in said multi-directional central top connector, a erecting short pole connection disposed on the top surface of said multi-directional central top connector penetrates said tarpaulin cloth and receives a screw fastening cover to fasten said tarpaulin cloth.

6. The bar table shelter according to claim 1, wherein each of said upright panels has a decoration pattern panel for increasing standing stableness of said bar table shelter.

7. The bar table shelter according to claim 3, wherein said screw hand wheel fixes said table plate with said central upright pole by screw and fastens the separate portions of said table as one piece.

8. The bar table shelter according to claim 4, wherein said U-shaped support fork has mounting holes on its two side walls, said radium long bone has a hole, a pin with a lock nut put said radium long bone on said U-shaped support fork firmly through said holes.

9. The bar table shelter according to claim 1, wherein said top center multi-directional connector has claw sleeve tubes, one end of said long bones are inserted into said claw sleeve tubes and are locked automatically.

10. The bar table shelter according to claim 1, wherein said first and second upright poles are hollow member.

11. The bar table shelter according to claim 2, wherein said middle upright pole has a substantively equal height with the second upright pole of said upright panel.

* * * * *